United States Patent [19]

Claassen

[11] Patent Number: 4,876,982

[45] Date of Patent: Oct. 31, 1989

[54] APPARATUS FOR THE APPLICATION OF LIQUID ADHESIVES TO A SUBSTRATE

[76] Inventor: Henning J. Claassen, Industriegebiet Hafen, 2120 Lüneburg, Fed. Rep. of Germany

[21] Appl. No.: 202,611

[22] Filed: Jun. 6, 1988

[30] Foreign Application Priority Data

Jun. 30, 1987 [DE] Fed. Rep. of Germany ..... 3721593

[51] Int. Cl.[4] ..... B05C 1/04

[52] U.S. Cl. ..... 118/406; 118/413; 118/419

[58] Field of Search ..... 118/100, 103, 107, 123, 118/125, 213, 200, 266, 259, 222, 231, 504, 406, 413, 419, 223, 261, 122, 410

[56] References Cited

U.S. PATENT DOCUMENTS

| | | | |
|---|---|---|---|
| 2,328,183 | 8/1943 | Barrett | 118/413 |
| 3,377,655 | 4/1968 | Kucharski et al. | 425/466 |
| 3,762,365 | 10/1973 | Herzog | 118/261 |
| 4,055,389 | 10/1977 | Hayward | 425/466 |
| 4,316,428 | 2/1982 | Flaum et al. | 118/259 |
| 4,411,614 | 10/1983 | Feathers | 425/467 |
| 4,465,015 | 8/1984 | Osta et al. | 118/259 |
| 4,534,308 | 8/1985 | Kretschmer | 118/260 |
| 4,613,526 | 9/1986 | Nakamura et al. | 118/413 |

FOREIGN PATENT DOCUMENTS

| | | |
|---|---|---|
| 2614596 | 7/1979 | Fed. Rep. of Germany . |
| 3506393 | 8/1986 | Fed. Rep. of Germany . |
| 3541784 | 5/1987 | Fed. Rep. of Germany . |
| 3542903 | 6/1987 | Fed. Rep. of Germany . |
| 3248889 | 2/1988 | Fed. Rep. of Germany . |

*Primary Examiner*—Willard Hoag

*Attorney, Agent, or Firm*—Armstrong, Nikaido, Marmelstein, Kubovcik & Murray

[57] ABSTRACT

An apparatus for the application of liquid adhesives to a substrate comprises a supply container for the adhesive and an applicator nozzle which is connected via a conduit to the supply container and has a slit-like outlet opening which communciates via a supply passage with a spreading chamber; at the slit-shaped outlet opening a doctor blade secured by a clamp support is arranged.

10 Claims, 2 Drawing Sheets

APPARATUS FOR THE APPLICATION OF LIQUID ADHESIVES TO A SUBSTRATE

BACKGROUND OF THE INVENTION

1. Field of the Invention

The invention relates to an apparatus for the application of liquid adhesives to a substrate.

2. Description of the Prior Art

An apparatus can be used in conjunction with both hot melts and cold glues if adhesives have to be applied to screen print rotary cylinders or engraved printing rollers and also to flat substrates, for example textile materials.

German Offenlegungsschrift No. 3,248,889 discloses an apparatus for the application of surface coatings to a textile substrate which comprises a nozzle-shaped mouth gap of a bar-shaped coating head which is subjected to pressure. In front of the coating head a perforated metal cylinder rotates as a template. The coating head contains a cavity and a chamber mouth which is defined by two sealing lips and is sealed laterally by a profile bar introduced on each of the two sides and having the same cross-section as the chamber mouth. The width of chamber mouth can be adjusted by using profile bars of various lengths or by displacing the profile bars.

U.S. patent application Ser. No. 937,859 discloses an apparatus for the intermittent application of liquids, such as adhesives, in particular hot melts, to a substrate moved relatively to the apparatus, in which upstream of the nozzle, a needle valve is provided for interrupting the flow from a supply container to the nozzle at desired intervals; Adjoining the supply conduit, in front of the main valve, is a return conduit to the supply container. In the return conduit, a second needle valve is disposed for shutting off the return conduit.

The second needle valve is larger than the main valve and is a pre-valve in the supply conduit at a short distance upstream of the main valve. The valves can be controlled in an adjustable time relationship with respect to each other so that even at high frequencies, an optimum application of the adhesive is achieved. In particular at the start and end of the application.

Finally, an apparatus for the application of liquid adhesives of the type set forth is apparent from German patent specification No. 3,541,784. The apparatus comprises a supply container and an applicator nozzle for the adhesive as well as a shut-off valve in the conduit from the supply container to the nozzle. The nozzle is formed as slit nozzle having a slit emanating from a spreading chamber. The adhesive is supplied to the spreading chamber by a passage which opens centrally into the spreading chamber at an angle to the direction in which the slit adjoins the chamber. The chamber extends substantially on one side of the slit. To ensure optimum distribution of the adhesive over the entire width of the slit with a simple nozzle structure, the passage opens into the chamber from the other side of the slit.

The problem with all the conventional applicator apparatuses is that of obtaining a uniform adhesive layer on the substrate to be coated, taking into account, on the one hand, various layer thicknesses and on the other hand, the highly fluctuating viscosities of the adhesives to be applied.

In particular, it has not hitherto been possible to readjust the applicator nozzle rapidly for different layer thicknesses and/or viscosities of the adhesive.

SUMMARY OF THE INVENTION

The invention is therefore based on the problem of providing an apparatus for the application of liquid adhesives of the type set forth in which the aforementioned disadvantages do not occur. In particular, an apparatus is to be proposed which can be adapted simply and thus rapidly for different layer thicknesses and/or viscosities of the adhesive.

The invention therefore creates an apparatus for the application of liquid adhesives to a substrate comprising a supply container for the adhesive, and an applicator nozzle having a slit-shaped outlet opening and connected to the supply container via a conduit. The outlet opening is connected to a spreading chamber via a supply passage. A doctor blade, secured by a clamp support, is arranged at the slit-shaped outlet opening.

Expedient embodiments are defined by the features of the subsidiary claims.

The advantages achieved with the invention are based on the use of a doctor blade which is integrated into the applicator nozzle and which by means of a clamp support can easily be removed and thus replaced. When the doctor blade is worn out, or when the operating conditions change, it is only necessary to release the clamping screw, which according to a preferred embodiment, by means of a clamp plate connected thereto, serves to fix the doctor blade.

The new doctor blade is then introduced into the gap between the clamp plate and the opposite wall of the applicator head and fixed again by tightening the clamping screw.

It has been found particularly favourable for the applicator nozzle to have at its side of the oncoming substrate a bevelled planar surface which forms with the doctor blade an angle which is less than 90°. In this way a buildup space for the emerging material is formed outside the applicator nozzle in the space bordered by the applicator nozzle on the one hand and the substrate or doctor blade on the other. On the side of the oncoming substrate the doctor blade should extend at least flush with the corresponding lower side of the applicator nozzle. According to a preferred embodiment, however, the lower end of the applicator metal sheet projects somewhat beyond the corresponding lower side of the applicator nozzle in order to define the aforementioned buildup space.

On the side of the outgoing substrate, however, the front edge of the doctor blade must project at least 0.5 mm beyond the portion of the applicator nozzle, which is located downstream from the doctor blade, in the coating direction so that a relatively large free space is available there.

The applicator nozzle can serve not only for coating planar substrates, for example textile materials, but also for coating curved substrates, for example printing cylinders, engraved printing rollers and the like. The coating operation can be adapted to the form of the substrate and also to the layer thickness to be applied and the viscosity of the adhesive by selecting a suitable doctor blade.

To obtain a further possibility for defining the coating thickness and in particular also the coating width, in conjunction with the doctor blade, a likewise interchangeable mask metal plate with a recess is used, serving to adjust the coating width and also the amount of adhesive to be dispensed.

If the applicator nozzle consists substantially of two relatively thick plane-parallel plates, as known from German patent specification No. 3,541,784, the mask metal plate is clamped between the two plates, which are held by screws.

If required, more than one doctor blade can also be used and clamped by means of the clamp plate. This makes it possible to obtain a graduating pressure decrease at the doctor edge.

To further increase the uniformity of the applied layer, the lower edge of the doctor blade may be rounded and have, for example, in cross-section a semicircular form. For special uses it is even expedient to integrate a rotatable mounted rotating rod into the doctor edge. The rod turns due to the relative motion between the applicator nozzle and the substrate, thereby effecting a uniform coating.

The rotating rod can consist of suitable plastic. Good results have been achieved with polytetrafluoroethylene.

The doctor blade ensures the clean intermittent coating even with adhesives which are difficult to handle, giving a self-contained application system which applies in each case only an exactly defined amount of adhesive. This system can be combined with any desired shutoff valve.

The applicator nozzle may also have the structure known from German patent specification No. 3,541,784 which has certain production technology advantages which can also be implemented in conjunction with the exchangeable doctor blade of the exchangeable mask plate, both being able to consist of a metal sheet.

Finally, with such an applicator nozzle both cold glues and hot glues, the so called "hot melts", can be applied because the applicator nozzle can easily be heated due to the simple construction consisting largely of metal.

BRIEF DESCRIPTION OF THE DRAWINGS

The invention will be explained hereinafter in detail with the aid of examples of embodiment with reference to the enclosed schematic drawings, wherein.

DESCRIPTION OF THE PREFERRED EMBODIMENTS

Figure 1:
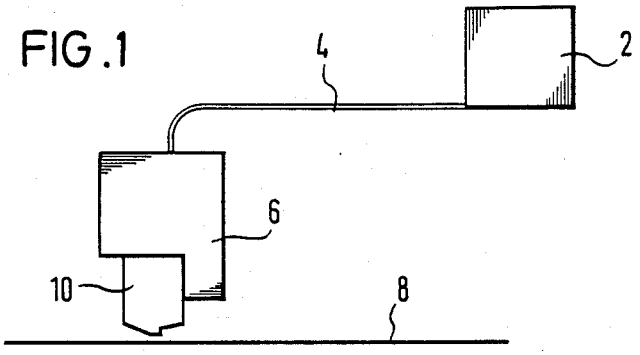
FIG. 1 is a side view of an apparatus for the batchwise application of an adhesive to a web-like material.

The apparatus shown schematically in FIG. 1 has a melting means 2 for a holt melt which is melted and collected in a molten state in a basin. From the basin a conduit 4 extends to an applicator head 6. The transport of the molten hot melt is by means of a pressure pump with appropriately high pressure provided in the device 2.

The applicator head includes a valve means so that the hot melt emerging from the applicator nozzle 10 disposed at the bottom on the applicator head 3, can be applied in exactly defined amounts to the web 8 moved forward beneath the applicator nozzle 10.

Depending on the valve construction chosen, a conduit for returning the hot melt to the melting means 2 may also be provided at the applicator head 6. This return conduit is necessary when, due to the valve arrangement used for supplying the nozzle 10, the supply flow is not simply shut off but instead the hot melt flowing through the conduit 4, on switching of the valve to non-application, is again fed without being retarded into a return conduit, not shown, leading to the melt means 2.

The applicator nozzle 10 can have the structure shown in German patent specification No. 3,541,784, while suitable valve constructions are apparent from U.S. patent application Ser. No. 937,859.

Figure 2:
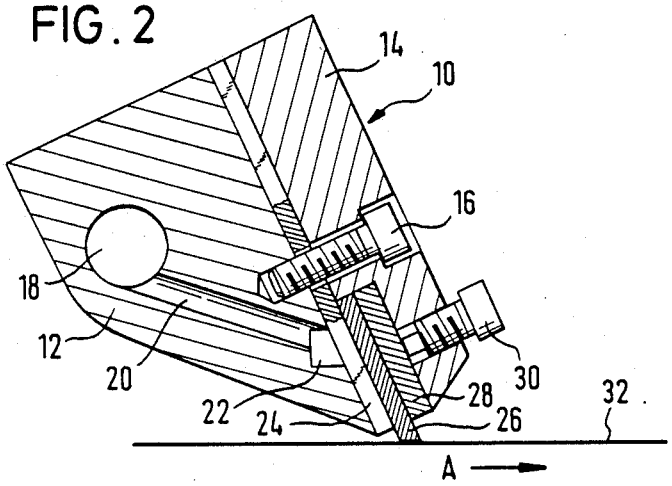
FIG. 2 is a vertical section through the applicator nozzle of the apparatus.

The applicator nozzle indicated in FIG. 2 by the reference numeral 10 consists substantially of two relatively thick plane-parallel plates 12 and 14, the faces of which are screwed together by means of screws 16. One screw 16 is shown in FIG. 2.

The applicator nozzle 10 is screwed, in a manner not shown, from below against the applicator head 6 so that a supply passage in the applicator head 6 connects to a bore 18 in the plate 12. The bore 18 is connected via a passage 20 to a spreading chamber 22 which is formed in the end face of the plate 12 facing the plate 14.

Figure 6:
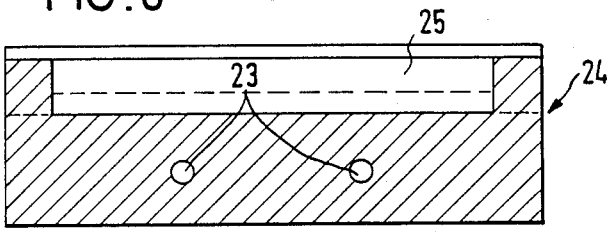
FIG. 6 is a section through the mask.

Between the plates 12 and 14, a mask 24 (see also FIG. 6) consisting of spring steel is disposed and serves to define the coating thickness and the coating width. The mask 24 has a closed surface facing the plate 14 and on its surface facing the plate 12 comprises a recess 25 which extends at least from the spreading chamber 22 up to the lower end of the plate 12. The width of this recess 25 shown in FIG. 6 defines the coating width while by corresponding selection of the depth of the recess 25 the amount of adhesive leaving the spreading chamber 22 and entering the recess 25 of the mask and thus the coating thickness can be defined.

On assembly of the two plates 12, 14 by means of the screws 16, the mask 24 is mounted at the same time between the two plates 12, 14. The holes for passage of the screws 16 are denoted by the reference numeral 23 in FIG. 6.

In its lower region the end face of the plate 14 facing the plate 12 has a recess in which a doctor blade 26, consisting of a metal sheet, and a clamp plate 28, which is connected with a clamp screw 30, are arranged. By tightening the clamp screw 30 the clamp plate 28 presses the doctor blade 26 against the mask 24 so that the doctor blade 26 is mounted in the position shown in FIG. 2 in which its lower end projects slightly beyond the lower edges of the two plates 12, 14.

By releasing the clamp screw 30 and thus the clamp plate 28, the doctor blade 26 can be removed and replaced by another, for example a new doctor blade, or also by a doctor blade with different dimensions.

As can be seen in FIG. 2, a substrate 32 is moved beneath the applicator nozzle 10 in the direction of the arrow A. On the side of the oncoming substrate of the applicator nozzle 10 the plate 12 has a bevelled end face which forms with the direction of the doctor blade 26 an angle of less than 90°. As a result, a buildup space for the adhesive emerging from the mask 24 is formed between the substrate 32 on the one hand and the end face of the plate 12 or doctor blade 26 on the other hand.

The lower engagement edge of the doctor blade 26, taking account of the position of the applicator nozzle 10 and the shape of the substrate 32, has such a form that the entire lower edge bears on the substrate 32. With the shown inclined position of the applicator nozzle with respect to the substrate 32, the lower edge of the doctor blade 26 must therefore be correspondingly bevelled to permit this planar engagement.

On the side of the outgoing substrate of the doctor blade 26 the distance maintained between the lower edge of the plate 14 and the lower front edge of the doctor blade 26 should be such that the front edge projects at least 0.5 mm beyond the lower edge of the plate 14.

On the side of the oncoming substrate the lower edge of the doctor blade 26 may also extend flush with the lower edge of the plate 12; however, according to a preferred embodiment the doctor blade 26 projects somewhat beyond the lower edge of the plate 12 (see FIG. 2).

Figure 3:
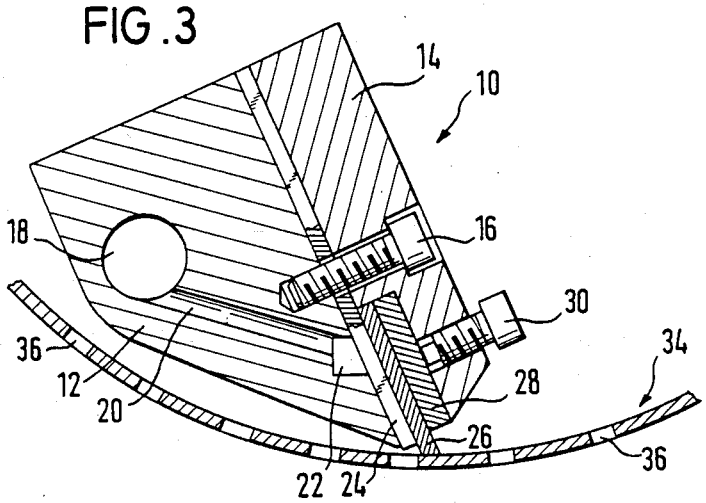
FIG. 3 is a vertical section through an applicator nozzle for coating a screen printing cylinder.

Whereas FIG. 2 represents the coating of a planar, for example textile, substrate 32, FIG. 3 shows the coating of a screen printing cylinder 34 with openings 36 using the applicator nozzle 10 having the same construction as in the embodiment of FIG. 2. It is apparent that with unchanged dimensions, substrates with inner curvature can also be coated.

Figure 4:
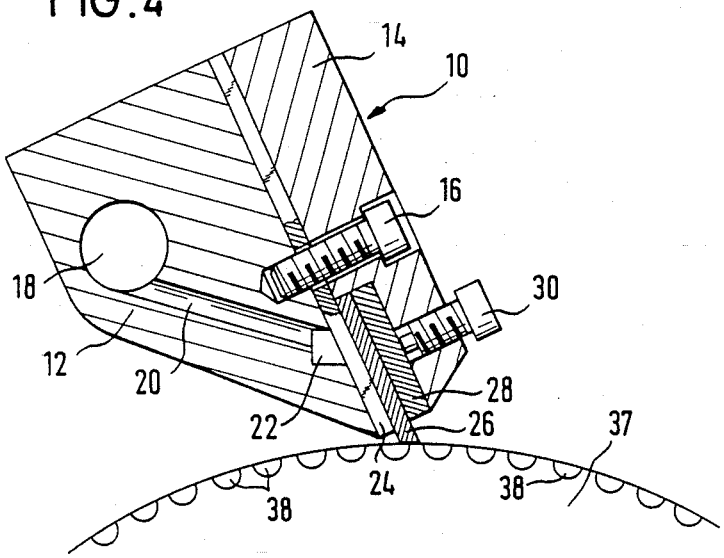
FIG. 4 is a vertical section through the applicator nozzle during the coating.

FIG. 4 shows the applicator nozzle 10 for the coating of an outwardly curved cylindrical substrate, i.e. an intaglio engraved printing roller 37 with depressions 38 which are filled with an adhesive.

Figure 5:
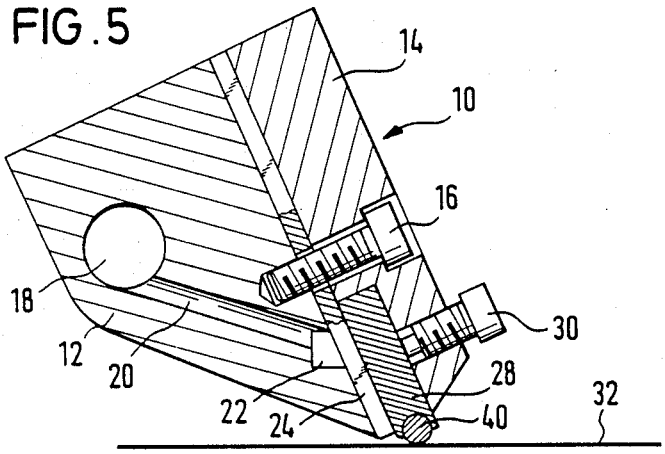
FIG. 5 is a vertical section through the applicator nozzle with a different embodiment of the doctor blade.

Finally, FIG. 5 shows a modification of the applicator nozzle 10 which differs from the embodiments so far described in that a rotating rod 40 is integrated into the lower edge of the doctor blade 28. The rotating rod 40 is freely rotatable during the coating and lies on the planar substrate 32, contributing to the uniformity of the coating. The rotating rod may be made from metal or a suitable plastic, in particular polytetrafluoroethylene.

I claim:

1. An apparatus for the application of liquid adhesives to a substrate, comprising:

a supply container for the adhesive;

a conduit connected to said supply container;

an applicator nozzle defining a slit-shaped outlet opening and connected to the supply container via said conduit;

a supply passage;

a spreading chamber connected to said slit-shaped outlet opening via said supply passage;

a doctor blade of sheet metal being arranged at the slit-shaped outlet opening; and a clamp support securing said doctor blade to said nozzle at said slit-shaped outlet opening, said clamp support including an engaging clamp plate connected to said nozzle with a clamp screw.

2. An apparatus according to claim 1, wherein the engaging clamp plate is formed from a clamp metal sheet bearing on the doctor blade.

3. An apparatus according to claim 1, wherein the applicator nozzle consists of two plates connected to each another and wherein the doctor blade is located in a recess in an end face of one plate.

4. An apparatus according to claim 1, wherein on the side of the oncoming substrate the end face of the applicator nozzle forms an angle of less than 90°, especially 60° to 40°, with the doctor blade.

5. An apparatus according to claim 1, wherein the lower edge of the doctor blade on the side of the outgoing substrate is spaced at least 0.5 mm from the applicator nozzle.

6. An apparatus according to claim 1, wherein a shape of the engagement edge of the doctor blade conforms to a shape of the substrate to be coated.

7. An apparatus according to claim 1, wherein the lower edge of the doctor blade is curved.

8. An apparatus according to claim 1, wherein a rotating rod is integrated into the lower edge of the doctor blade.

9. An apparatus according to claim 1, wherein the slit-shaped outlet opening is formed by a recess in an interchangeable mask.

10. An apparatus according to claim 9, wherein the mask consists of spring steel.

* * * * *